US010312627B2

(12) United States Patent
Kim et al.

(10) Patent No.: US 10,312,627 B2
(45) Date of Patent: Jun. 4, 2019

(54) ELECTRONIC DEVICE HAVING FLEXIBLE CABLE AND METHOD OF MANUFACTURING THE SAME

(71) Applicant: Samsung Electronics Co., Ltd., Gyeonggi-do (KR)

(72) Inventors: Ji Min Kim, Gyeonggi-do (KR); Byoung Uk Yoon, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 14/932,592

(22) Filed: Nov. 4, 2015

(65) Prior Publication Data

US 2016/0126659 A1 May 5, 2016

(30) Foreign Application Priority Data

Nov. 4, 2014 (KR) ..... 10-2014-0152004

(51) Int. Cl.

| | |
|---|---|
| ***H04R 1/10*** | (2006.01) |
| ***H01R 13/62*** | (2006.01) |
| ***H04R 5/033*** | (2006.01) |
| ***H01R 13/504*** | (2006.01) |

(52) U.S. Cl.

CPC ..... *H01R 13/504* (2013.01); *H04R 1/1066* (2013.01); *H01R 13/6205* (2013.01); *H04R 1/1016* (2013.01); *H04R 1/1041* (2013.01); *H04R 5/0335* (2013.01)

(58) Field of Classification Search

CPC .. H01R 13/504; H01R 13/6205; H01R 43/18; H01R 43/24; H01R 13/405; H01R 13/5845

See application file for complete search history.

(56) References Cited

U.S. PATENT DOCUMENTS

| | | | | |
|---|---|---|---|---|
| 5,189,431 | A * | 2/1993 | Marinelli | H01Q 1/273 343/718 |
| 6,069,319 | A * | 5/2000 | Davis, Jr. | B29C 44/12 174/110 F |
| 7,175,339 | B2 * | 2/2007 | Bisig | G04G 17/083 368/204 |
| 7,422,469 | B1 * | 9/2008 | Chang | B29C 45/14467 439/449 |
| 8,498,428 | B2 | 7/2013 | Schreuder et al. | |
| 8,514,559 | B2 * | 8/2013 | Yu | H01R 12/721 361/679.31 |
| 8,655,006 | B2 | 2/2014 | Aase et al. | |
| 9,332,338 | B2 * | 5/2016 | Hsieh | H04R 1/105 |
| 9,362,776 | B2 * | 6/2016 | Low | G04C 10/00 |
| 9,560,432 | B2 * | 1/2017 | Hsieh | H04R 1/105 |
| 2007/0064542 | A1 * | 3/2007 | Fukushima | G04B 37/1486 368/282 |

(Continued)

*Primary Examiner* — Edwin A. Leon
*Assistant Examiner* — Oscar C Jimenez
(74) *Attorney, Agent, or Firm* — The Farrell Law Firm, P.C.

(57) ABSTRACT

An electronic device is provided. The electronic device includes a first coupling part and a second coupling part that is connectable to the first coupling part. A connection part connects the first coupling part to the second coupling part and includes an upper end portion, a lower end portion that is connected to the upper end portion, and a wire part that is disposed between the upper end portion and the lower end portion.

13 Claims, 12 Drawing Sheets

(56) References Cited

U.S. PATENT DOCUMENTS

| | | | | |
|---|---|---|---|---|
| 2007/0259536 | A1* | 11/2007 | Long | H01R 13/6205 439/39 |
| 2009/0311910 | A1* | 12/2009 | Kleinke | H01R 9/03 439/607.51 |
| 2010/0217096 | A1* | 8/2010 | Nanikashvili | A61B 5/02438 600/301 |
| 2011/0180302 | A1 | 7/2011 | Aase et al. | |
| 2011/0180962 | A1 | 7/2011 | Aase et al. | |
| 2011/0182460 | A1 | 7/2011 | Aase et al. | |
| 2012/0052810 | A1 | 3/2012 | Schreuder et al. | |
| 2013/0118801 | A1* | 5/2013 | Cheng | H01R 13/504 174/74 R |
| 2014/0024248 | A1* | 1/2014 | Chen | G06F 13/38 439/502 |
| 2014/0042197 | A1 | 2/2014 | Skenderian | |
| 2014/0110882 | A1 | 4/2014 | Aase et al. | |
| 2015/0021091 | A1 | 1/2015 | Aase et al. | |
| 2015/0185765 | A1* | 7/2015 | Peek | G02B 6/42 351/158 |
| 2016/0141773 | A1* | 5/2016 | Emrys | H01B 3/307 439/540.1 |
| 2016/0190733 | A1* | 6/2016 | Ho | H01R 24/62 439/39 |
| 2016/0262275 | A1* | 9/2016 | Peek | G02B 6/42 |
| 2017/0042125 | A1* | 2/2017 | Kim | A01K 11/00 |

* cited by examiner

ELECTRONIC DEVICE HAVING FLEXIBLE CABLE AND METHOD OF MANUFACTURING THE SAME

PRIORITY

This application claims priority under 35 U.S.C. § 119(a) to Korean Patent Application Serial number 10-2014-0152004, which was filed on Nov. 4, 2014 in the Korean Intellectual Property Office, the entire disclosure of which is incorporated herein by reference.

BACKGROUND

1. Field of the Disclosure

The present disclosure relates generally to an electronic device, and more particularly, to an electronic device having a flexible cable and a method of manufacturing the electronic device having the flexible cable.

2. Description of the Related Art

Wearable devices, e.g., an earphone, a headset, a smart watch, a smart glasses, etc., which are used in conjunction with one or more types of electronic devices, e.g., smart phones, table PCs, etc., have been developed.

Cables that can be used with the wearable devices for connecting the wearable devices to an electronic device have a constant cross-sectional area. Accordingly, the cable is sometimes not consistent with design and functional requirements of the wearable device.

SUMMARY

The present disclosure has been made to address at least the above-mentioned problems and/or disadvantages and to provide at least the advantages described below. Accordingly, an aspect of the present disclosure is to provide an electronic device that is consistent with design and functional requirements of a wearable device using a cable having appearance continuously varied.

An aspect of the present disclosure is to provide a method of manufacturing an electronic device that is consistent with design and functional requirements of a wearable device using a cable having appearance continuously varied.

In accordance with an aspect of the present disclosure, there is provided an electronic device. The electronic device includes a first coupling part, a second coupling part that is detachably connectable to the first coupling part, and a connection part connecting the first coupling part to the second coupling part. The connection part includes an upper end portion, a lower end portion that is connected to the upper end portion, and a wire part that is disposed between the upper end portion and the lower end portion.

In accordance with an aspect of the present disclosure there is provided a method of manufacturing an electronic device comprising a flexible cable. The method includes disposing a wire on a first mold, performing a first injection molding process to form a first portion of the flexible cable and a fixing portion connected to the first portion, performing a second injection molding process to form a second portion of the cable, and removing the fixing portion.

Other aspects, advantages, and features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description, taken in conjunction with the accompanying drawings, in which.

Throughout the drawings, it should be noted that like reference numbers are used to depict the same or similar elements, features, and structures.

DETAILED DESCRIPTION

Figure 1:
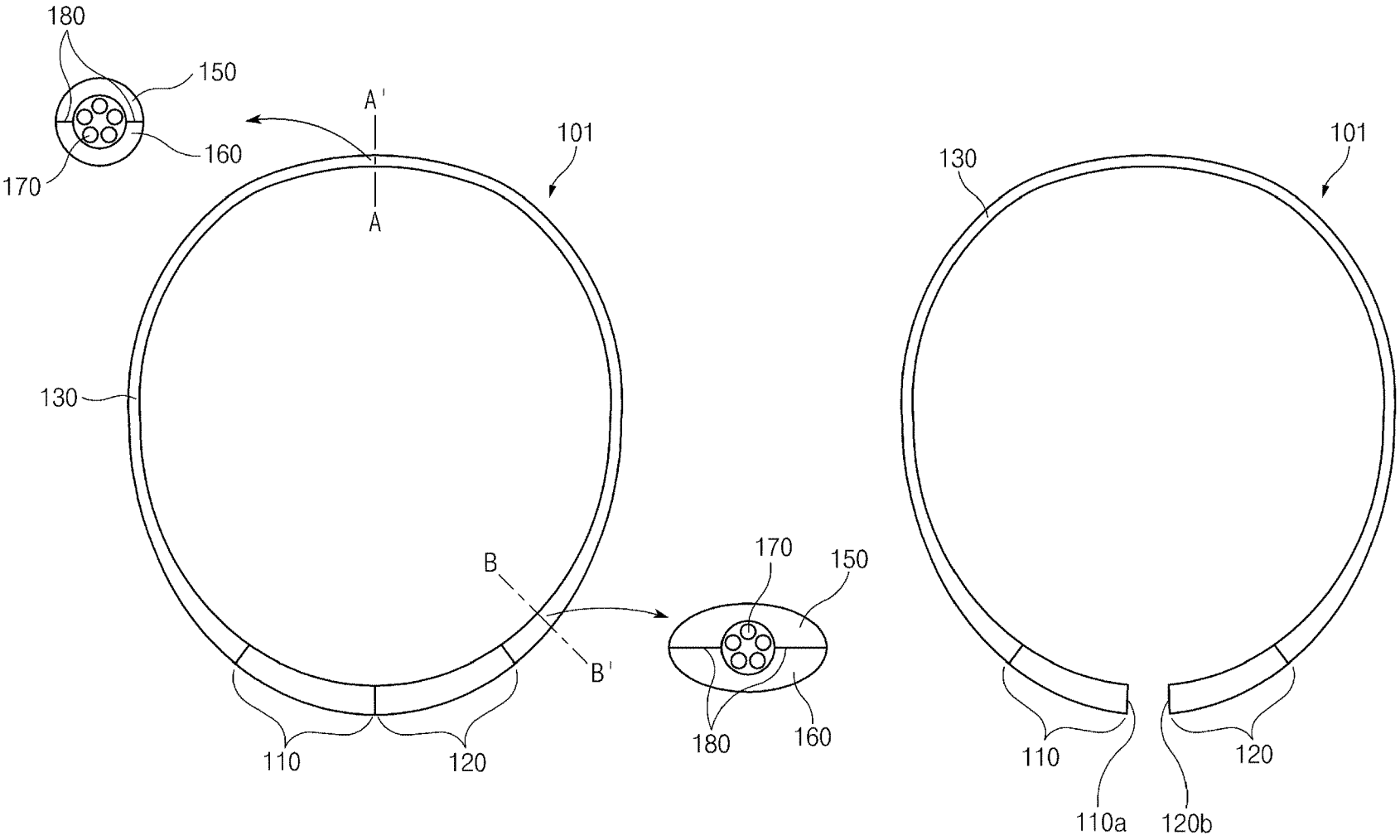
FIG. 1 is view showing an electronic device according to an embodiment of the present disclosure.

Hereinafter, embodiments of the present disclosure are described in detail with reference to the accompanying drawings. Those of ordinary skill in the art will recognize that various changes and modifications of the embodiments described herein can be made without departing from the scope and spirit of the present disclosure. In addition, descriptions of well-known functions and constructions may be omitted for clarity and conciseness. The same reference symbols are used throughout the drawings to refer to the same or like parts.

It should be noted that various embodiments described below may be applied or used individually or in combination.

The terms "include," "comprise," "including," or "comprising" used herein indicates disclosed functions, operations, or existence of elements but do not exclude other functions, operations or elements.

The meaning of the terms "or" or "at least one of A and/or B" used herein include any combination of words listed together with the term. For example, the expression "A or B" or "at least one of A and/or B" may indicate A, B, or both A and B.

The terms, such as "first", "second", and the like used herein may refer to various elements of various embodiments of the present disclosure, but do not limit the elements. For example, such terms do not limit the order and/or priority of the elements. Furthermore, such terms may be used to distinguish one element from another element. For example, "a first user device" and "a second user device" may indicate different user devices. For example, a first element may be referred to as a second element, and similarly, a second element may be referred to as a first element.

In the description below, when one part (or element, device, etc.) is referred to as being "operatively or communicatively coupled" with/to or "connected" to another part (or element, device, etc.), it should be understood that the former can be "directly connected" to the latter, or "electrically connected" to the latter via an intervening part (or element, device, etc.). It will be further understood that when one component is referred to as being "directly connected" or "directly linked" to another component, it means that no intervening component is present.

The term "configured to" as used herein may be interchangeably used with terms, such as "suitable for", "having the capacity to", "designed to", "adapted to", "made to", "capable of", etc., depending on circumstances. The term "configured to" used herein should not be limited to "specifically designed to" in terms of hardware. The term "device configured to" as used herein may indicate "device capable of being provided with" other devices or components. For instance, the phrase "processor configured to perform A, B, and C" may indicate a dedicated processor, e.g., an embedded processor, to perform a corresponding operation or a general-purpose processor, e.g., a CPU, an application processor, etc., to perform the corresponding operation by running at least one program stored in a memory.

The term "module" as used herein may represent, for example, a unit including one or more combinations of hardware, software and firmware. The term "module" may be interchangeably used with the terms "unit", "logic", "logical block", "component" and "circuit". The "module" may be an integrated component or may be a part thereof. The "module" may be for performing one or more functions or a part thereof. The "module" may be implemented mechanically or electronically. For example, the "module" may include at least one of an application-specific IC (ASIC) chip, a field-programmable gate array (FPGA), and a programmable-logic device for performing some operations.

Terms used in this specification are used to describe embodiments of the present disclosure and are not intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal sense unless expressly so defined herein in various embodiments of the present disclosure.

Electronic devices according to the various embodiments of the present disclosure may include at least one of smart phones, smart pads, tablet personal computers (PCs), mobile phones, video phones, electronic book readers, desktop PCs, laptop PCs, netbook computers, workstations, servers, personal digital assistants (PDAs), portable multimedia players (PMPs), motion picture experts group (MPEG-1 or MPEG-2) Audio Layer 3 (MP3) players, mobile medical devices, cameras, wearable devices (e.g., head-mounted-devices (HMDs), such as electronic glasses), electronic apparels, electronic bracelets, electronic necklaces, electronic appcessories, smart watches, or the like.

The electronic devices may be smart home appliances. The smart home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync®, Apple TV®, or Google TV®), game consoles (e.g., Xbox®, PlayStation®), electronic dictionaries, electronic keys, camcorders, electronic picture frames, or the like.

In addition, the electronic device may include at least one of, for example, various medical devices (e.g., various mobile medical meters (a blood glucose meter, a heart rate meter, a temperature meter, etc.), a magnetic resonance angiography (MRA) device, a magnetic resonance imaging (MRI) device, a computed tomography (CT) device, a camcorder, an ultrasonic device, etc.), navigation devices, global positioning system (GPS) receivers, event data recorders (EDRs), flight data recorders (FDRs), car infotainment devices, marine electronic equipments (e.g., a marine navigation device, a gyro compass, etc.), avionics, security equipments, car head units, industrial or household robots, automates teller machines (ATMs) for financial institution, point of sales (POS) in store, or internet of things (e.g., a bulb, various sensors, an electric or gas meter, a sprinkler, a fire alarm, a thermostat, a street light, a toaster, a fitness equipment, a hot water tank, a heater, a boiler, etc.).

In addition, the electronic device may include at least one of, for example, portions of furniture or building/structure, electronic boards, electronic signature receiving devices, projectors, or various measuring equipments (e.g., a water, electricity, gas, or electric wave measuring device). The electronic device may be one or a combination of the above-mentioned various devices. The electronic device may be a flexible electronic device. In addition, the electronic device should not be limited to the above-mentioned devices or equipments.

Hereinafter, the electronic device will be described in detail with reference to accompanying drawings. In the following description, a "user" may be referred to as a person or a device (e.g., an artificial intelligence electronic device) who or which uses the electronic device.

FIG. 1 is a diagram illustrating an electronic device 101, according to an embodiment of the present disclosure.

Referring to FIG. 1, the electronic device 101 includes a first coupling part 110, a second coupling part 120, and a third coupling part 130. The electronic device 101 may be a wearable device in which a portion of the first coupling part 110 and a portion of the second coupling part 120 may be coupled or connected to or separated from each other. For instance, the electronic device 101 may be a wearable device, such as a necklace-type earphone, a headset, an electronic necklace, a band-type device (e.g., a wearable hair band, a wrist band, etc.), an electronic bracelet, smartglasses, goggles, etc. Hereinafter, the necklace-type earphone or the headset will be described as the electronic device 101, but the electronic device 101 should not be limited to the necklace-type earphone or the headset.

The first coupling part 110 and the second coupling part 120 are selectively connectable to each other. That is, a user may connect (or couple) or separate the first coupling part 110 to or from the second coupling part 120, and thus the user may wear the electronic device 101 on a part of a body or hang the electronic device 101 on an object or thing, e.g., a bag, a desk, etc.

The first coupling part 110 and the second coupling part 120 may be connected to each other by the connection part 130. The first coupling part 110 and the second coupling part 120 may include various components required to drive the electronic device 101. For instance, the first coupling part 110 and the second coupling part 120 may include a sound device used to output a sound and an input/output device, e.g., a power button, a function button, etc.

The first coupling part 110 and the second coupling part 120 may include a battery that is used to drive the electronic device 101. The battery may be disposed in either or both of the first coupling part 110 and the second coupling part 120.

The connection part 130 connects the first coupling part 110 and the second coupling part 120 and supports the first coupling part 110 and the second coupling part 120. The connection part 130 includes a wire part 170 that is configured to transfer an electrical signal. The connection part 130 transfers the electrical signal between the first coupling part 110 and the second coupling part 120 through the wire part 170.

The connection part 130 may have any suitable configuration or shape, in consideration of characteristics of the wearable device. For instance, in the case where the electronic device 101 is an earphone or a headset, at least a portion (e.g., portions adjacent to the first coupling part 110 and the second coupling part 120) of the connection part 130 may have an elliptical shape in a cross-section thereof. In the case where the user wears the electronic device 101 around a neck, the connection part 130 having the elliptical shaped cross-section may be stably placed around the user's neck.

The connection part 130 may be formed of any suitable material, e.g., a flexible material. For instance, the connection part 130 may be formed of a material (e.g., urethane, silicon, rubber, etc.) having high elasticity and high flexibility, and a material that is not harmful to the user's body. In the case where the user puts the first coupling part 110 and the second coupling part 120 to the ear after separating the first coupling part 110 and the second coupling part 120 from each other, the connection part 130 may be bent.

The connection part 130 may have a cross-sectional area that continuously varies along a length of the wire part 170. For instance, in the case where the user wears the electronic device 101 around the neck, a portion corresponding to a rear portion of the neck may have a circular shape in a cross-section taken along a line A-A' and a portion adjacent to the first coupling part 110 and the second coupling part 120 may have an elliptical shape in a cross-section taken along a line B-B'. A diameter in a first direction, i.e., a horizontal direction, of the portion taken along the line A-A' may be smaller than a diameter in the first direction of the portion taken along the line B-B'. The connection part 140 may be formed by an injection molding method using a mold; however, other molding methods, e.g., an extrusion molding method that extrudes a material through a hole, may also be used.

The connection part 130 includes an upper end portion 150, a lower end portion 160, and the wire part 170.

The upper end portion 150 and the lower end portion 160 may surround the wire part 170. The upper end portion 150 and the lower end portion 160 may insulate the wire part 170 from the outside and determine an appearance of the connection part 130. As noted above, the connection part 130 may be formed from urethane, silicon, rubber, etc.; however, the upper end portion 150 and the lower end portion 160 may be formed of different materials. For example, the upper end portion 150 may be formed from urethane and the lower end portion 160 may be formed from silicon, or vice versa. Likewise, the upper portion 150 and lower portion 160 may each be formed from different materials. For example, a portion of the upper portion 150 can be formed from silicon and another portion or the upper portion 150 can be formed from rubber; similar configurations can also be used for forming the lower portion 160.

The upper end portion 150 and the lower end portion 160 may be separated from each other by a parting line 180 formed by the injection molding process. The parting line 180 may be formed by a plurality of injection molding processes. For instance, one portion of the upper end portion 150 and the lower end portion 160 may be formed by a first injection molding process and another portion of the upper end portion 150 and the lower end portion 160 may be formed by a second injection molding process. The forming of the parting line 180 and the injection molding process will be described in more detail with reference to FIGS. 2 and 3.

The wire part 170 may include or be formed from a conductive material to transfer an electrical signal. The wire part 170 may be disposed at a center portion of the connection part 130. The wire part 170 may include one or more wires that transfer the electrical signal, and a sheath may surround the wire. The sheath may have a thickness of about 0.33 mm, which is determined for a specific injection molding process or contemplated use of the electronic device 101. The sheath can have a thickness that is less than or greater than 0.33 mm. A coating layer formed by a painting, depositing, or transcribing process may further be disposed on a surface of the wire part 170.

The first coupling part 110 may have a cross-section area 110*a* and the second coupling part 120 may have a cross-section area 120*a* that makes contact with or is separated from the cross-section area 110*a*. The cross-section area 110*a* of the first coupling part 110 may have a shape corresponding to that of the cross-section area 120*a* of the second coupling part 120. In the case where the electronic device 101 is an earphone or a headset, the user may put the first coupling part 110 and the second coupling part 120 to the ear after separating the first coupling part 110 and the second coupling part 120 from each other to listen to the sound or to make a phone call. In the case where the electronic device 101 receives calls with respect to an external device linked with the electronic device 101, the user may make a phone call by separating the first coupling part 110 and the second coupling part 120 from each other.

The electronic device 101 may include the first coupling part 110, the second coupling part 120 that is coupled to or separated from the first coupling part, and the connection part 130 for connecting the first coupling part 110 to the second coupling part 120. The connection part 130 may include the upper end portion 150 and the lower end portion 160 which is distinguished from the upper end portion 150 by the parting line 180. The wire part is disposed between the upper end portion 150 and the lower end portion 160.

The connection part 130 may have a cross-sectional area that continuously varies in a longitudinal direction of the wire part 170. The connection part 130 may form a continuous appearance together with the first coupling part 110 and the second coupling part 120. The connection part 130 may include a straight or curved cutting line on an external surface thereof.

The wire part 170 may be disposed at the center portion of the connection part 130. The parting line 180 may be formed by one or more suitable injection molding processes.

The upper end portion 150 may be formed of a first material and the lower end portion 160 may be formed of a second material that is different from the first material. The connection part 130 may further include a joint part connected to both ends of the wire part 170 and coupled to the first coupling part 110 and the second coupling part 120. The joint part may move or be extended in the longitudinal direction of the wire part 170 within a predetermined range.

The first coupling part 110 and the second coupling part 120 may be coupled to or separated from each other by a magnet. The first coupling part 110 and the second coupling part 120 may have substantially the same weight or a weight within a predetermined range from each other. The first coupling part 110 and the second coupling part 120 may include a circuit board and the circuit board may include at least one flexible portion. The first coupling part and the second coupling part 120 may include a circuit board, and the circuit board may include at least one stacked structure.

Figure 2:
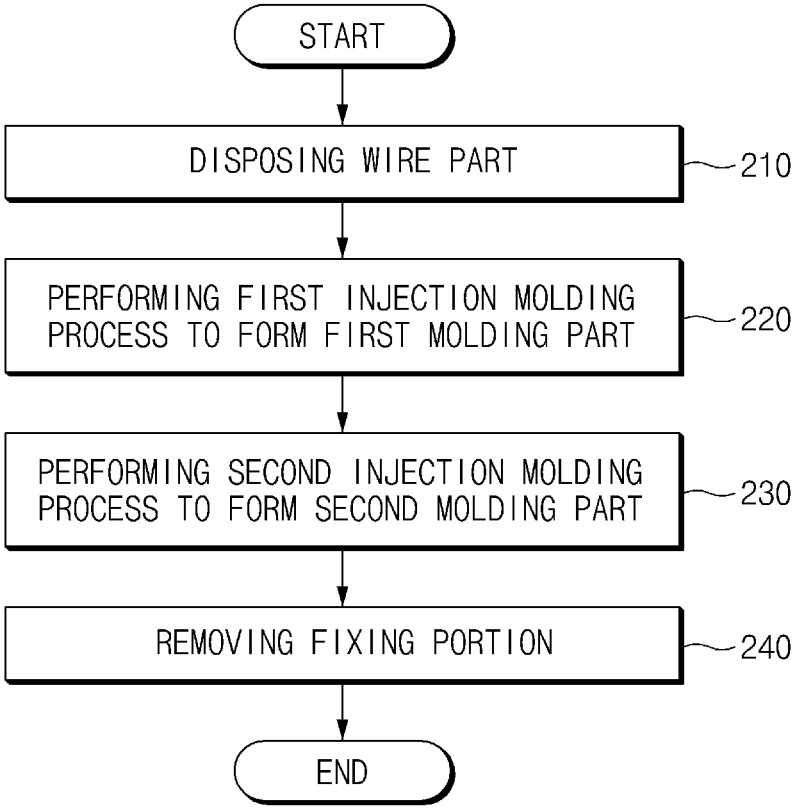
FIG. 2 is a flowchart illustrating a method of forming a connection part using an injection molding process, according to an embodiment of the present disclosure.

FIG. 2 is a flowchart illustrating a method of forming the connection part 130 using an injection molding process, according to an embodiment of the present disclosure.

Referring to FIG. 2, in step 210, the wire part 170 may be disposed in a mold before the upper end portion 150 and the lower end portion 160 are formed. The wire part 170 may be disposed at the center portion of the mold to allow the wire part 170 to be disposed at the center portion of the connection part 130 after the connection part 130 is completely formed. In the case where the wire part 170 is disposed at the center portion of the connection part 130, the wire part 170 may be prevented from being exposed to the outside and from being twisted.

In step 220, a first molding part may be formed by a first injection molding process. The first molding part may be obtained by coupling a portion, which is formed in the lower end portion 160 (or the upper end portion 150) by additional processes, and a fixing portion. The fixing portion may fix the first molding part such that the first molding part does not move in a mold used during a second injection molding process performed after the first injection process. The fixing portion may serve as a barrier wall to prevent a fluid resin from flowing toward the first molding part during the second injection process. The fixing portion may be removed after the second injection process is completed.

In step 230, the second molding part may be formed by the second injection process. The second molding part may be formed in the upper end portion 150 (or the lower end portion 160) by additional processes. The second molding part may be formed at an opposite side with respect to the first molding part as viewed relative to the wire part 170 and may be distinguished from the first molding part by the parting line 180.

In step 240, the fixing portion included in the first molding part may be removed. After the fixing portion is removed, the connection part 130 may be completed. A cutting line may be formed on the external surface of the connection part 130 from which the fixing portion is removed. Additional information on the injection molding process for the connection part 130 may be provided with reference to FIG. 3.

Figure 3A:
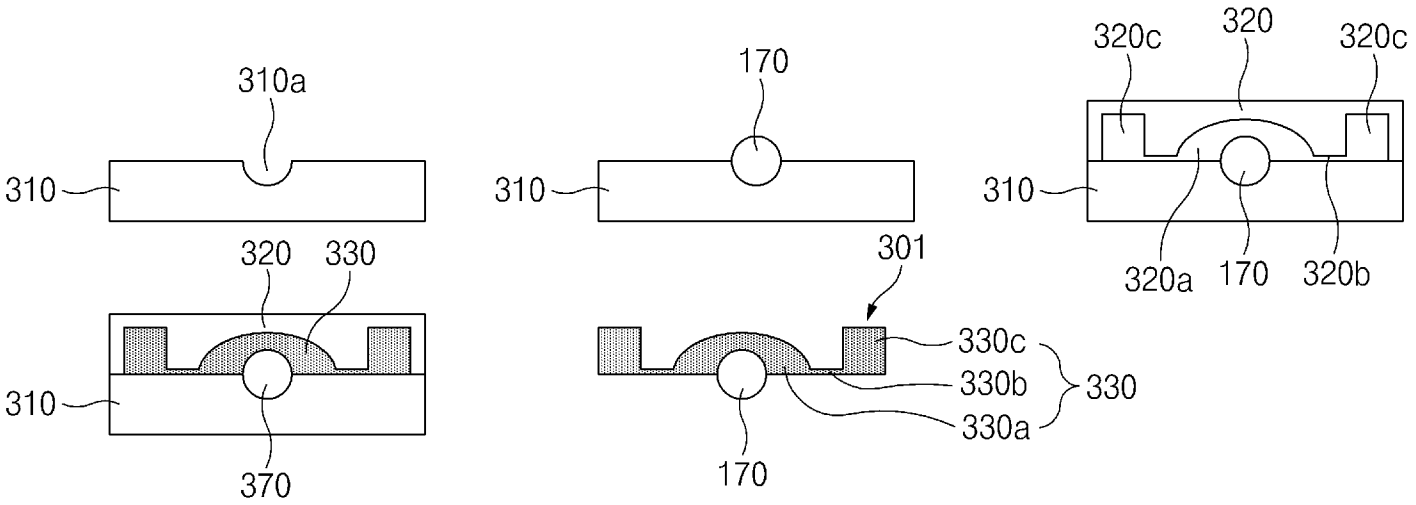
FIGS. 3A-3C are diagrams illustrating an injection molding process to form a connection part, according to an embodiment of the present disclosure.
Figure 3B:
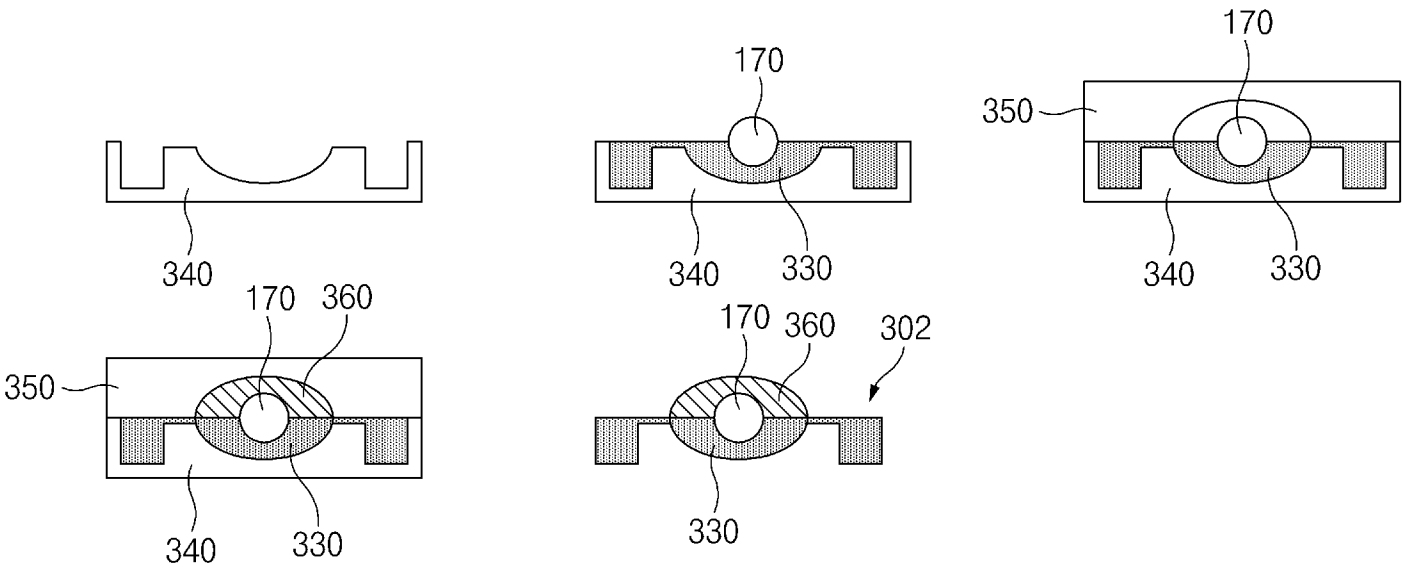
Figure 3C:
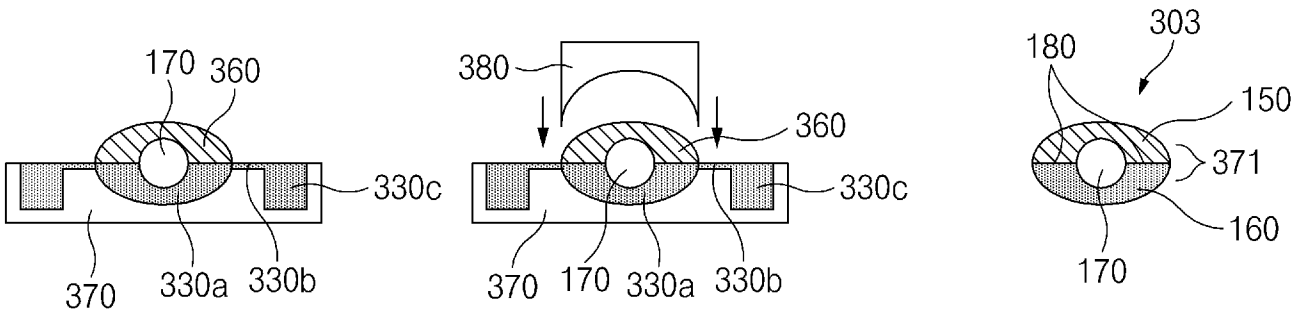

FIGS. 3A-3C are diagrams illustrating an injection molding process to form the connection part 130, according to an embodiment of the present disclosure. In FIGS. 3A-3C, the lower end portion 160 of the connection part 130 is formed before the upper end portion 150 of the connection part 130 is formed, but they should not be limited thereto or thereby.

FIG. 3A is a view showing a process of forming the first molding part, according to an embodiment of the present disclosure.

Referring to FIG. 3A, a first mold 310 may be prepared in the first injection molding process. The first mold 310 includes a recess 310*a* formed in a center portion thereof, in which the wire part 170 is disposed.

After the wire part 170 is disposed in the recess 310*a*, a second mold 320 may be coupled on the first mold 310 via one or more suitable coupling methods. The second mold 320 may include an inner space through which the fluid resin (e.g., urethane, silicon, rubber, etc.) enters, after injection, to form the first molding part. The inner space may include an area 320*a* in which the lower end portion 160 is formed and areas 320*b* and 320*c* in which the fixing portion is formed. The area 320*b* may be used to form an overflow portion and the area 320*c* may be used to form a guide portion.

After the fluid resin enters the second mold 320, a heat treatment process and a cooling process may be performed on the fluid resin, and thus an injection-molded object 301 may be formed. The injection-molded object 301 may include the first molding part 330 and the wire part 170. The first molding part 330 may include a body portion 330*a*, an overflow portion 330*b*, and a guide portion 330*c*. The guide portion 330*c* may prevent the first molding part 330 from moving in a mold used in the second injection molding process. The overflow portion 330*b* may connect the body portion 330*a* and the guide portion 330*c* and may serve as the barrier wall to prevent the fluid resin from flowing in the second injection molding process.

FIG. 3B is a diagram illustrating a process of forming the second molding part, according to an embodiment of the present disclosure.

Referring to FIG. 3B, a third mold 340 may be prepared in the second injection molding process. The third mold 340 may have a shape corresponding to that of the first molding part 330 formed by the first injection process.

After the first molding part 330 is disposed on the third mold 340, a fourth mold 350 may be disposed on the third mold 340. The fourth mold 350 may include an area required to form the upper end portion 150, without a separate area required to form the fixing portion.

After a fluid resin enters the fourth mold 350, a heat treatment process and a cooling process may be performed, and thus the second molding part 260 may be formed. The fixing portion, e.g., the overflow portion 330*b* and the guide portion 330*c*, may prevent the first molding part 330 from moving during the second injection molding process and may serve as the barrier wall to prevent the fluid resin from flowing, which is used to form the second molding part 360.

The parting line 180 may be formed between the first molding part 330 and the second molding part 360 by the first and second injection molding processes. The wire part 170 may be disposed on an inner extension portion of the parting line 180.

The molds 340 and 350 may be removed and an injection-molded object 302 obtained by coupling the first molding part 330, the second molding part 360, and the wire part 170 may be formed. The injection-molded object 302 includes the fixing portion (the overflow portion 330*b* and the guide portion 330*c*) which may be removed by a cutting process.

FIG. 3C is a diagram illustrating the process of cutting the fixing portion, according to an embodiment of the present disclosure.

Referring to FIG. 3C, A fixing jig 370 may have a shape corresponding to the injection-molded object 302 so that the injection-molded object 302 may be seated in or fixed to the fixing jig 370 for cutting the fixing portion (the overflow portion 330*b* and the guide portion 330*c*) from the injection molded object 302, using a cutting device 380.

The fixing portion may cut using a straight or curved cutting line 371. The cutting line 371 may be placed at a position at which the upper end portion 150 makes contact with the lower end portion 160 on the external surface of the connection part 130. For instance, the cutting line 371 may be oriented along a straight cutting line to allow the fixing portion (the overflow portion 330*b* and the guide portion 330*c*) to be easily cut by the cutting device 380. Alternatively, the cutting line 371 may be oriented along a curved cutting line such that the upper end portion 150 is smoothly connected to the lower end portion 160. In FIGS. 3A-3C, the lower end portion 160 may be formed by the first injection molding process and the upper end portion 150 may be formed by the second injection molding process, but they should not be limited thereto or thereby. For instance, the connection part 130 may be manufactured by forming the upper end portion 150 using the first injection process and forming the lower end portion 160 using the second injection process.

The manufacturing method of the electronic device 101 including a flexible cable may include disposing a wire part 170 in a first mold 310, forming a first portion of the cable and a fixing portion connected to the first portion using the first injection molding process, forming a second portion of the cable using the second injection molding process, and removing the fixing portion.

Forming the fixing portion may include forming at least one overflow portion 320*b* extending from the first portion and forming a guide portion 320*c* extending from the overflow portion 320*b*.

Disposing the wire in the first mold 310 may include disposing the wire in a recess 310*a* formed by partially removing the first mold 310.

Forming the first portion and the fixing portion connected to the first portion may include coupling the second mold 320 to the first mold 310, injecting the fluid resin to an inner space 320*a* of the second mold 320, and performing the heat treatment process and the cooling process.

Removing the fixing portion may include separating the fixing portion from the first portion along a straight or curved cutting line.

Figure 4A:
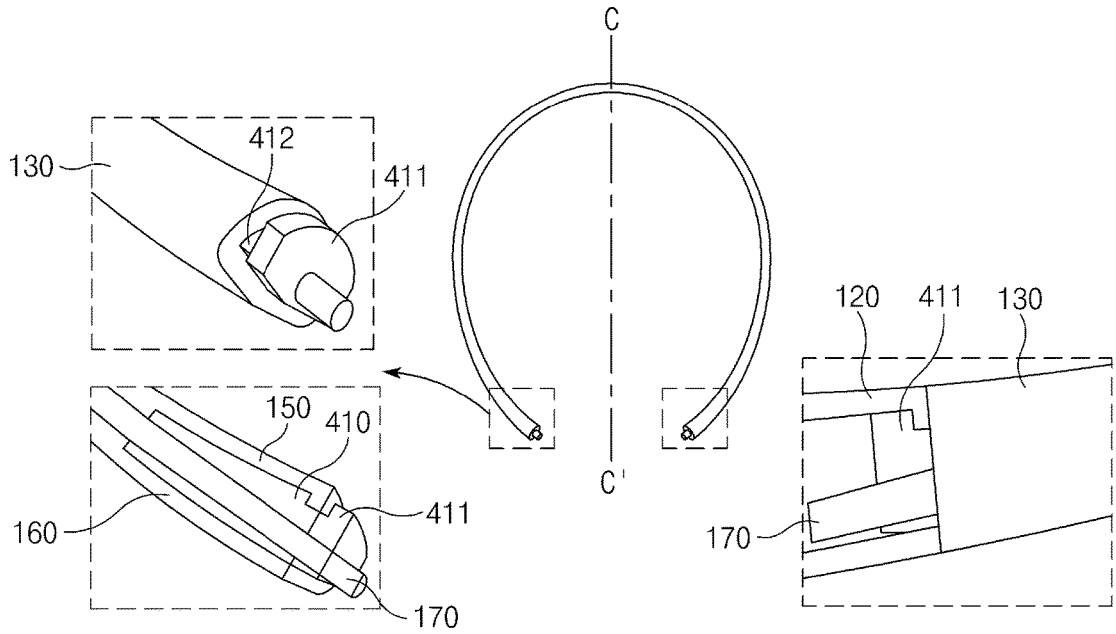
FIGS. 4A and 4B are diagrams illustrating a connection part including a joint part, according to an embodiment of the present disclosure.
Figure 4B:
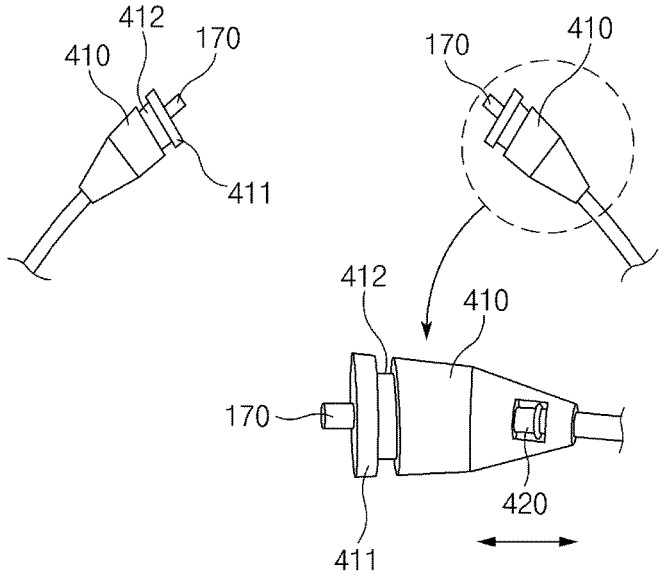

FIGS. 4A and 4B are diagrams illustrating a connection part 130 including a joint part 410, according to an embodiment of the present disclosure.

Referring to FIG. 4A, the connection part 130 may have a bilateral symmetry with respect to a center line C-C'. The connection part 130 may have the smallest cross-sectional area in an area adjacent to the center line C-C' and may have the greatest cross-sectional area in both end areas connected to the first coupling part 110 and the second coupling part 120. The connection part 130 may be formed by the injection molding process described above with respect to FIGS. 2-3C such that the cross-sectional area (or the appearance) of the connection part 130 continuously varies along a length of the connection part 130.

The connection part 130 may include the joint part 410 disposed at each end of the connection part 130 for connecting to the first coupling part 110 and second coupling part 120.

The joint part 410 allows a housing of the first coupling part 110 and the second coupling part 120 to be easily coupled to the connection part 130. A first end portion of the joint part 410 may be surrounded by the upper end portion 150 and the lower end portion 160 of the connection part 130 and a second end portion of the joint part 410 may be connected to (or connectable with) the housing of the first coupling part 110 and/or the second coupling part 120. For illustrative purposes the second end portion is shown connected to the housing of the second coupling part. The second end portion of the joint part 410 may have a protrusion 411 at a distal portion thereof and a recess 412 at a proximal portion thereof such that the joint part 410 is easily connected to the housing of the first coupling part 110 and the second coupling part 120.

The wire part 170 extends through and past the joint part 410 and may be connected to the first coupling part 110 and the second coupling part 120. The joint part 410 may be injection-molded to be inserted into a portion of the wire part 170 or may be assembled with the wire part 170.

FIG. 4B is a diagram illustrating a joint part 410 having a moving structure, according to an embodiment of the present disclosure.

Referring to FIG. 4B, the joint part 410 may be coupled to both ends of the wire part 170. The joint part 410 may include at least one moving structure 420. In FIG. 4B, the joint part 410 is shown including one moving structure 420, but the number of the moving structures should not be limited to one.

The joint part 410 may be moved along the wire part 170 by the moving structure 420 within an allowed range. Due to the movement of the joint part 410, an overall length of the connection part 130 may be controlled. The moving structure 420 may allow the mold for the wire part 170 to be easily placed and may reduced defects occurring when the connection part 130 is formed.

Figure 5:
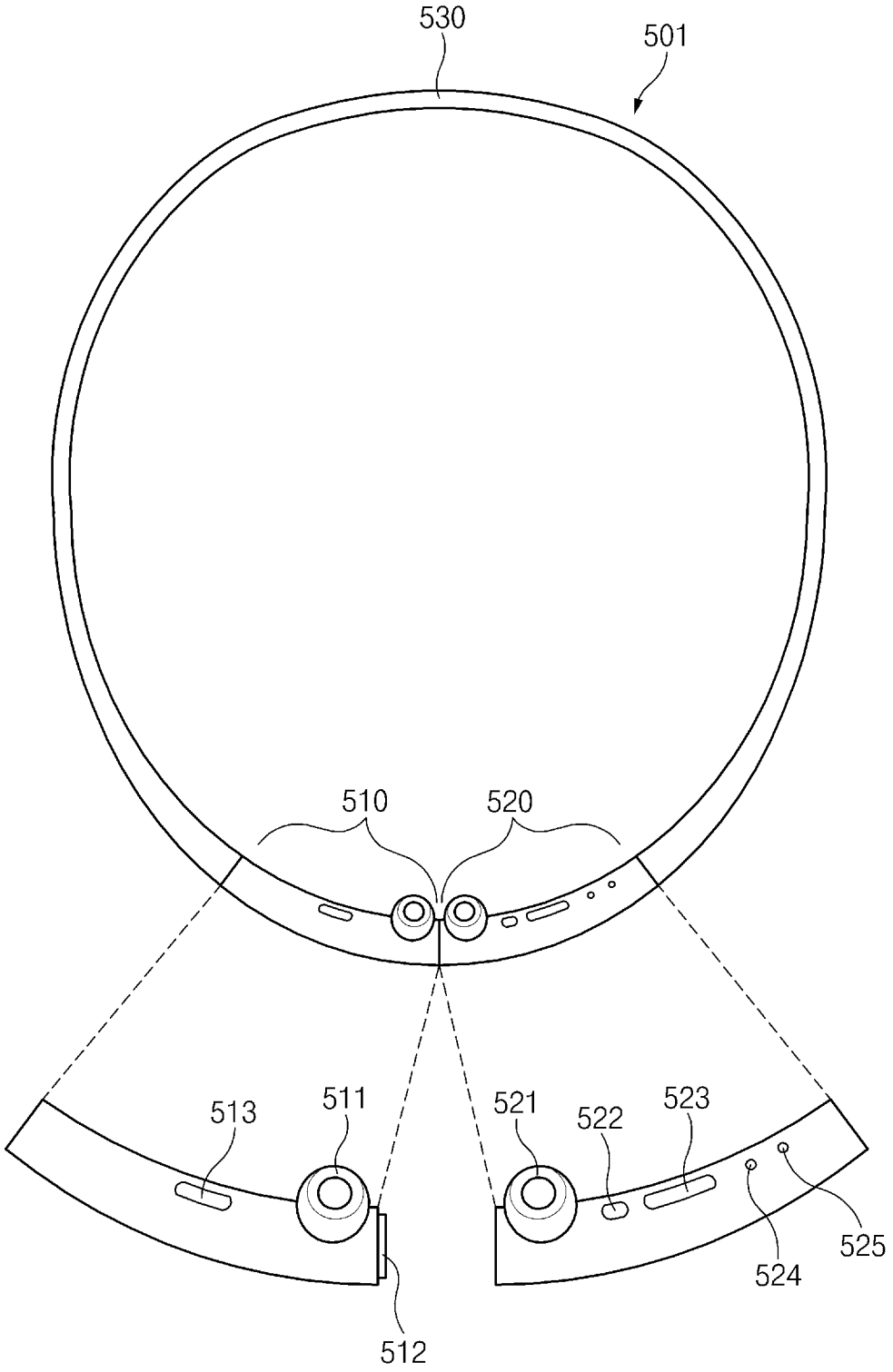
FIG. 5 is a diagram illustrating a necklace-type wearable device having a sound output function, according to an embodiment of the present disclosure.

FIG. 5 is a diagram illustrating a necklace-type wearable device having a sound output function, according to an embodiment of the present disclosure.

Referring to FIG. 5, an electronic device 501 may be a necklace-type earphone or a headset device. The electronic device 501 may include a first coupling part 510, a second coupling part 520, and a connection part 530 connecting to the first coupling part 510 and the second coupling part 520. The first coupling part 510 and the second coupling part 520 may include sound output modules 511 and 521, respectively. Each of the sound output modules 511 and 521 may include a speaker, a sound output circuit, and an ear tip. The user may put the ear tip to the ear to listen to music or to make a phone call.

The electronic device 501 may include a user interface, such as a button, a display device, etc. FIG. 5 shows various buttons and display devices, but it should not be limited thereto or thereby.

The first coupling part 510 may include a power button 513 and a cross-section cover 512. The user may turn on or off the electronic device 501 using the power button 513. The user may connect a cable to a socket of the electronic device 501 after opening the cross-section cover 512 to connect the electronic device 501 to an external device, e.g., a personal computer, or to charge the electronic device 501.

The second coupling part 520 may include a function key 522, a volume key 523, a display part 524, and a microphone part 525. The user may operate the above-mentioned buttons to listen to the music or to make the phone call. For instance, the user may push the function key 522 to start making a phone call or may push the function key 522 while making the phone call to make the phone call. The structure of the first coupling part 510 and the second coupling part 520 will be described in detail with reference to FIGS. 6 and 7.

Figure 6:
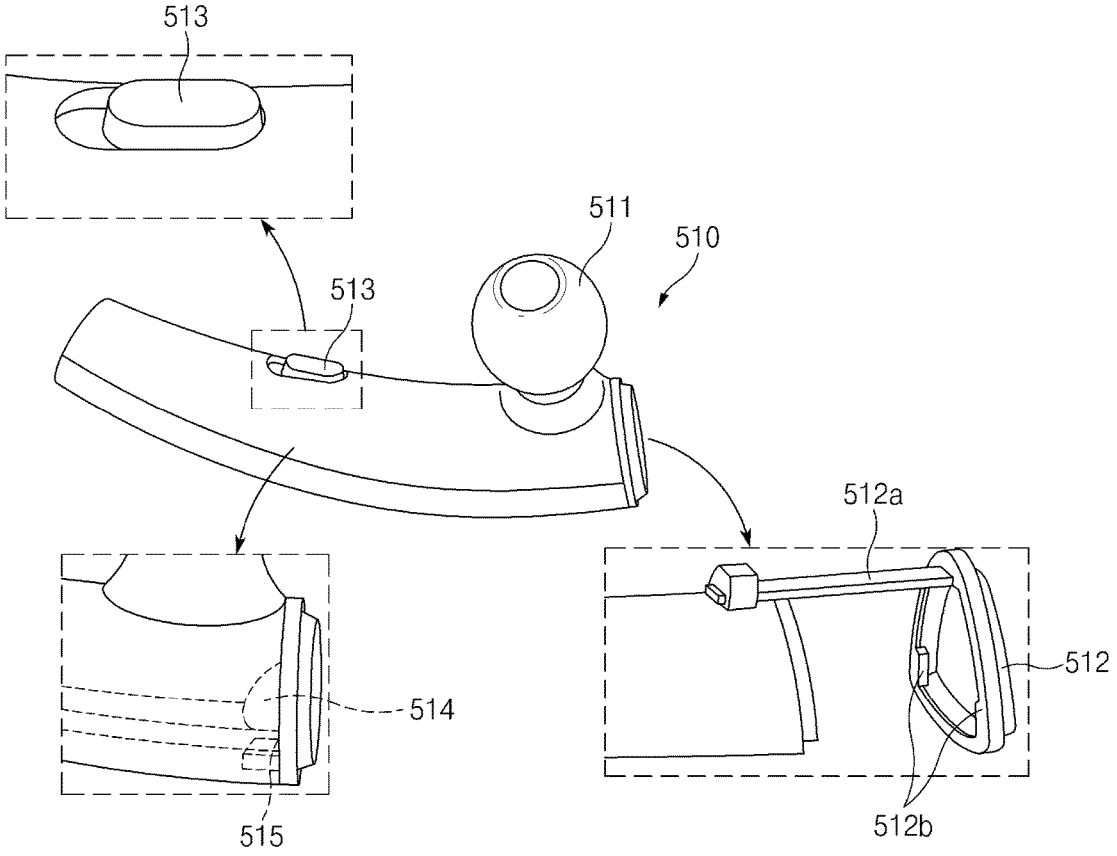
FIG. 6 is a diagram illustrating a first coupling part having a sound output function, according to an embodiment of the present disclosure.

FIG. 6 is a diagram illustrating the first coupling part 510 having a sound output function, according to an embodiment of the present disclosure.

Referring to FIG. 6, the first coupling part 510 may include the sound output module 511, the cross-section cover 512, and the power button 513. The sound output module 511 may include the speaker, the sound output circuit, and the ear tip. The user may put the ear tip to the ear to listen to the music or to make the phone call.

The user may turn on or off the electronic device 501 using the power button 513. The power button 513 may be embodied in a slide switch.

The user may connect the cable to the socket of the electronic device 501 after opening the cross-section area cover 512 to connect the electronic device 501 to the external device, e.g., the personal computer, or charging device to charge the electronic device 501. The cross-section area cover 512 may have a shape corresponding to that of the cross-section area of the second coupling part 520 and may have a shape, e.g., a c-cut shape, to prevent the cross-section area cover 512 from being rotated. The cross-section area cover 512 may include a connection structure 512*a* and a fixing structure 512*b* to prevent the cross-section cover area 512 from being separated.

The first coupling part 510 may include a magnet 514, and a socket 515 for charging the electronic device 501. The magnet 514 may be disposed adjacent to an end of the first coupling part 510 for making contact with the second coupling part 520. The socket 515 may be exposed to the outside, such as when the cross-section cover 512 is opened.

Figure 7:
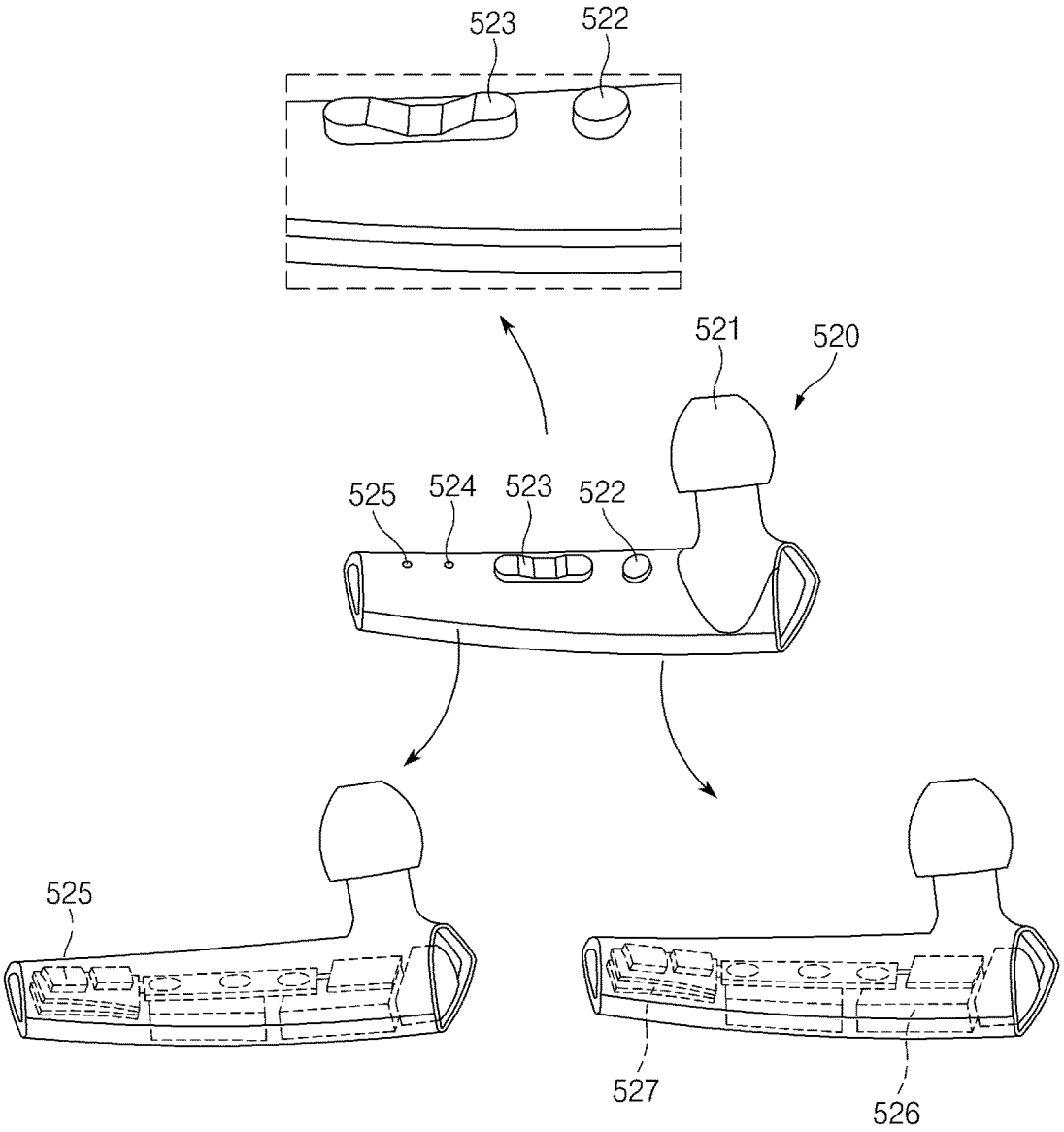
FIG. 7 is a diagram illustrating a second coupling part having a sound output function, according to an embodiment of the present disclosure.

FIG. 7 is a diagram illustrating a second coupling part having a sound output function, according to an embodiment of the present disclosure.

Referring to FIG. 7, the second coupling part 520 may include the sound output module 521, the function key 522, the volume key 523, the display part 524, and the microphone part 525. The sound output module 521 may include the speaker, the sound output circuit, and the ear tip. The user may put the ear tip to the ear to listen to the music or to make the phone call.

The user may push the function key 522 to make the phone call or may push the function key 522 while calling to make the phone call. The user may push the function key 522, when the electronic device 501 in a standby state, to start playing the music or to stop playing the music. The user may push the volume key 523 to control a volume output of the speaker while making the phone call or playing the music.

The display part 524 may indicate various states of the electronic device 501 to the user. The display part 524 may include a light emitting diode and may notify types of events through a color changing or flashing operation in the case where events, such as a call reception, a music reproduction, a notification, etc., occur.

The microphone part 525 may make a phone call using the electronic device 501 or may be used to receive a voice of the user. The microphone part 525 may be disposed spaced apart from the sound output module 521 by a predetermined distance to prevent sound quality from being degraded due to echo and howling, which may occur during the call.

The second coupling part 520 may further include a battery 526 and an antenna 527, e.g., Bluetooth® (BT) antenna.

Figure 8A:
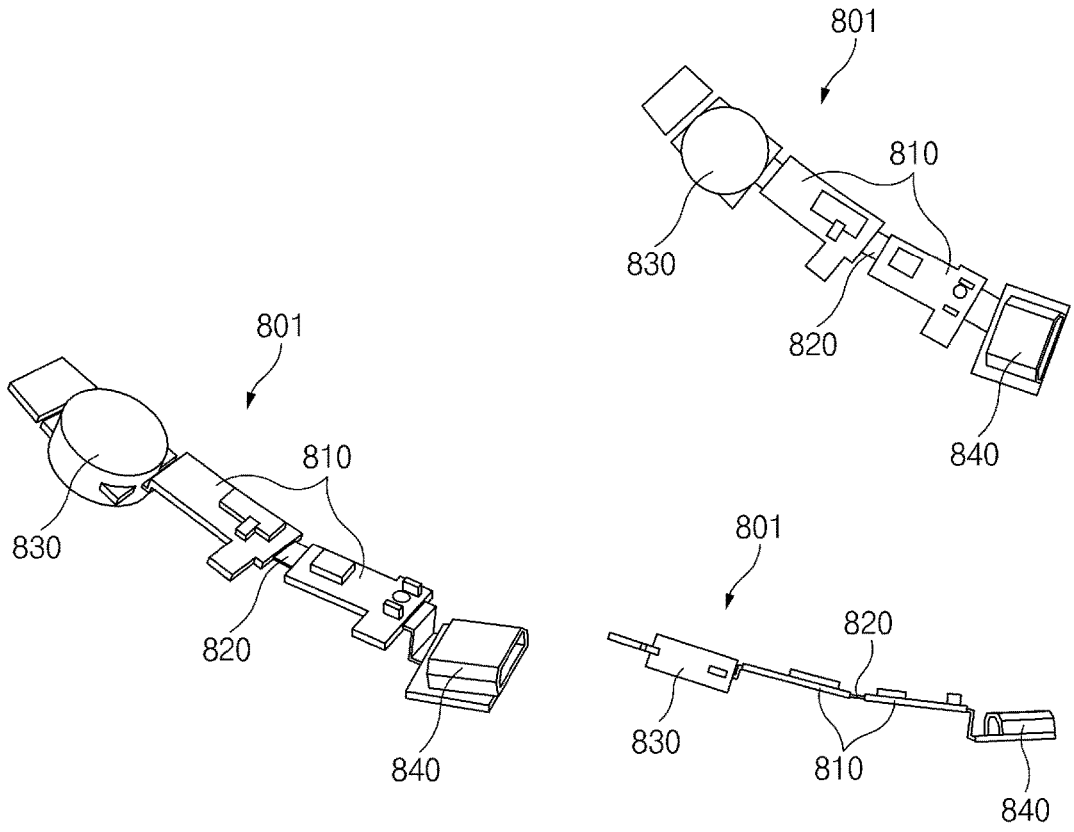
FIGS. 8A and 8B are diagrams illustrating an internal circuit board of a coupling part, according to an embodiment of the present disclosure.
Figure 8B:
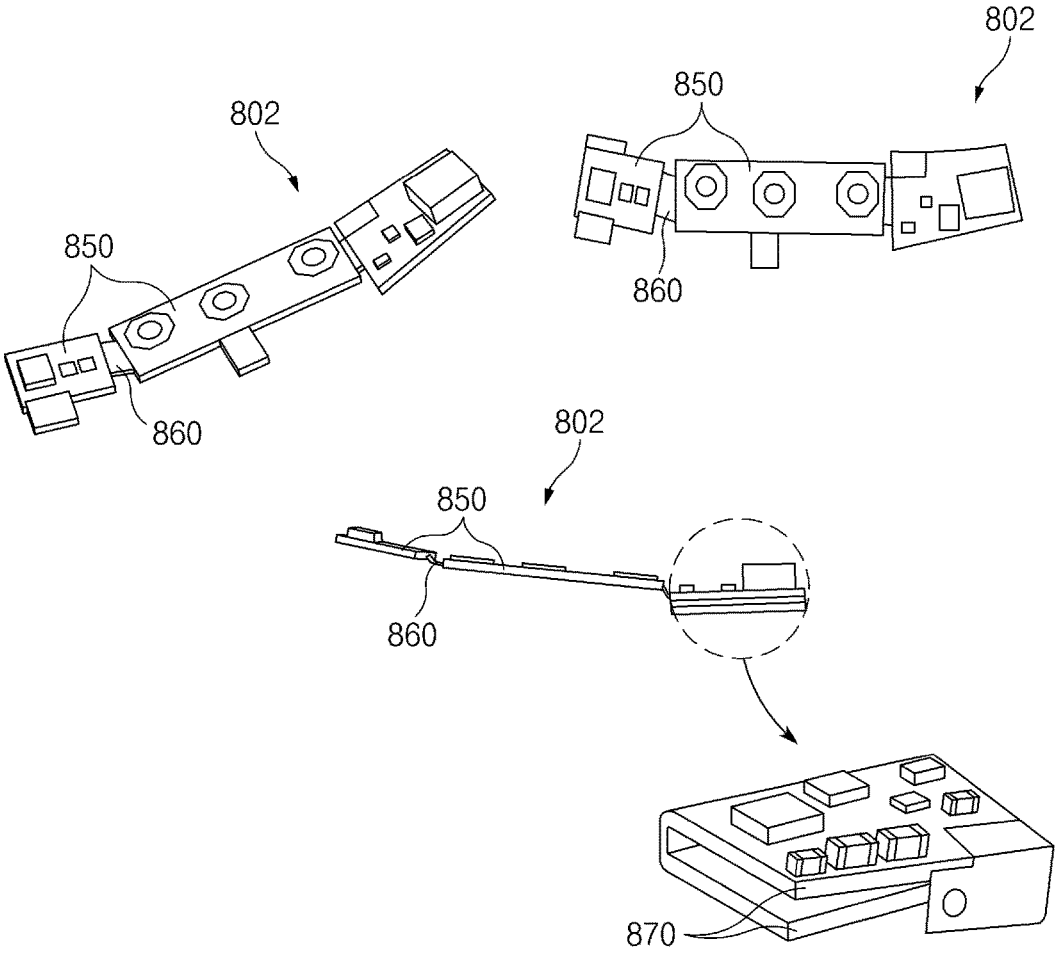

FIGS. 8A and 8B are diagrams illustrating an internal circuit board of a coupling part, according to an embodiment of the present disclosure. The configuration of the internal circuit board of the coupling part is not limited to those configurations shown in FIGS. 8A and 8B. The circuit board 801 or 802 may be realized in a three-dimensional manner in a housing of the coupling part described herein. For instance, the circuit board 801 may have a three-dimensional curved surface shape rather than a flat surface shape, and thus the circuit board 801 may adaptively respond to variations in design, and a mounting efficiency of components on the circuit board 801 may be improved.

FIG. 8A is a diagram illustrating a configuration of the circuit board 801 of the first coupling part.

Referring to FIG. 8A, the circuit board 801 includes a fixing portion 810 and a flexible portion 820 and may have a three-dimensional curved surface shape. The fixing portion 810 may be, but not limited to, a conventional printed circuit board (e.g., a rigid printed circuit board) and components required to drive the electronic device 501 may be mounted on the fixing portion 810. The flexible portion 820 may be provided so that the first coupling part may be conveniently worn on the user's body. The flexible portion 820 may transmit and/or receive electrical signals between the fixing portions 810. The circuit board 801 may include at least one flexible portion 820 to accommodate a variety of three-dimensional shapes.

The circuit board 801 may include a vibrator 830 and a socket 840. The vibrator 830 may generate a vibration in the case where events, such as a call reception, a music reproduction, a notification, etc., occur to notify the occurrence of the events to the user. The socket 840 may be exposed to the outside in the case where the cross-section area cover 512 is opened, and may be used to charge the electronic device 501 or to transfer data.

FIG. 8B is a diagram illustrating a configuration of the circuit board 802 of the second coupling part.

Referring to FIG. 8B, the circuit board 802 includes a fixing portion 850 and a flexible portion 860 and may have a three-dimensional curved surface shape. The fixing portion 850 may be, but is not limited to, the conventional printed circuit board and components required to drive the electronic device 501 may be mounted on the fixing portion 850. The flexible portion 860 may be provided so that the second coupling part may be conveniently worn on the user's body. The flexible portion 860 may transmit and/or receive electrical signals between the fixing portions 850. The circuit board 802 may include at least one flexible portion 860 to realize a variety of three-dimensional shapes.

The circuit board 801 or 802 may partially include a stacked structure 870 in consideration of characteristics of the wearable device in which a variety of components is mounted in a limited space. For instance, the circuit boards 801 or 802 may include the stacked structure 870 formed at both ends of the first and second coupling parts, at which the sound output modules 511 and 521 are respectively mounted.

Figure 9:
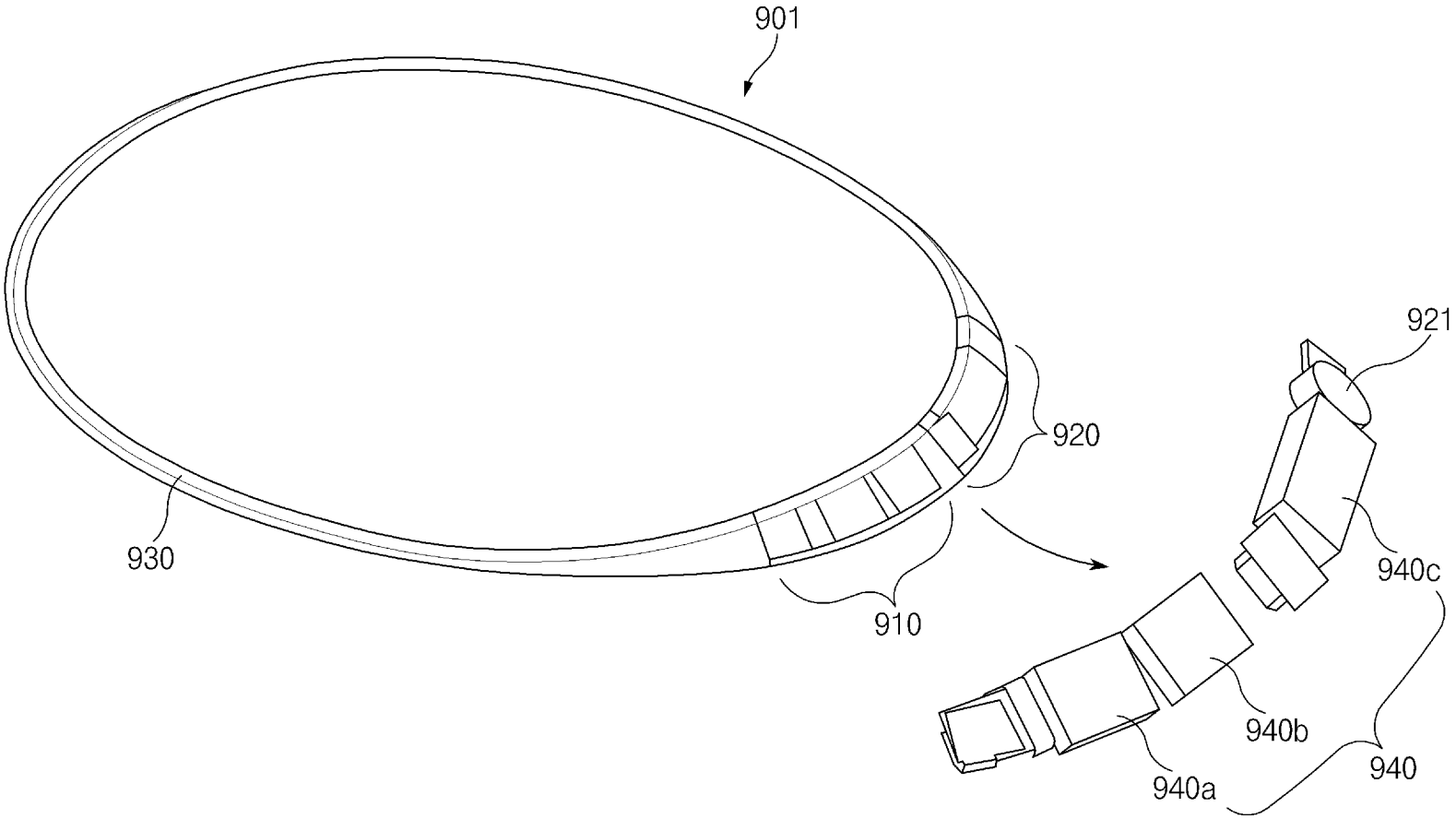
FIG. 9 is a diagram illustrating an internal battery of a coupling part, according to an embodiment of the present disclosure.

FIG. 9 is a diagram illustrating a configuration of an internal battery of a coupling part, according to an embodiment of the present disclosure. The configuration of the internal battery of the coupling part is not limited to that shown in FIG. 9.

Referring to FIG. 9, an electronic device 901 includes a first coupling part 910, a second coupling part 920, and a connection part 930. The electronic device 901 includes a battery 940 that supplies a power source voltage to the electronic device 901, and the battery 940 may be disposed in the first coupling part 910 and the second coupling part 920. The battery 940 may be divided by taking weight and shape of the components included in each of the first coupling part 810 and the second coupling part 920 into consideration. For instance, in the case where the second coupling part 920 includes a vibrator 921, the first coupling part 910 may include batteries 940*a* and 940*b* and the second coupling part 920 may include a battery 940*c* to allow the first coupling part 910 to have substantially the same weight as that of the second coupling part 920 or to allow a difference in weight between the first and second coupling parts 910 and 920 to be within a predetermined weight range.

The battery 940 may be disposed in the first coupling part 910 and the second coupling part 920 in consideration of the characteristics of the wearable device. For instance, in the case where the battery 940 is disposed adjacent to the user's body, the battery 940 may be disposed in the farthest distance possible from the user or may be disposed toward a direction opposite to a direction toward the user's body.

Devices required to perform a specific function may be disposed adjacent to each other in the first coupling part 910 or the second coupling part 920. In addition, devices, which are required to perform the same or similar function or frequently transmit and receive signals, may be disposed adjacent to each other in the first coupling part 910 or the second coupling part 920. Accordingly, a time delay caused by the signal transmission and reception may be reduced and the number of the wires included in the connection part 930 may be reduced. For instance, the first coupling part 910 may include devices, e.g., a processor, a memory, a microphone, a codec, etc., which are related to the sound output function or the phone call, and the second coupling part 920 may include the battery and the vibrator.

The electronic devices described herein may be configured with one or more components, and the names of the elements may be changed according to the type of the electronic device. The electronic device may include at least one of the above-mentioned elements, and some elements may be omitted or other additional elements may be added. Furthermore, some of the elements of the electronic device may be combined with each other so as to form one entity, so that the functions of the elements may be performed in the same manner as before the combination.

At least a portion of an apparatus (e.g., modules or functions thereof) or a method (e.g., operations) may be, for example, implemented by instructions stored in a non-transitory computer-readable storage media in the form of a programmable module. The instructions, when executed by one or more processors, may cause the one or more processors to perform a function corresponding to the instruction.

A non-transitory computer-readable recording medium may include hardware, which is configured to store and execute a program instruction (e.g., a programming module), such as a hard disk, a magnetic media such as a floppy disk and a magnetic tape, an optical media such as compact disc read only memory (CD-ROM) and a digital versatile disc (DVD), a magneto-optical media such as a floptical disk, and hardware devices such as read only memory (ROM), random access memory (RAM), and a flash memory. Also, a program instruction may include not only a mechanical code, such as things generated by a compiler, but also a high-level language code executable on a computer using an interpreter. The above hardware unit may be configured to operate via one or more software modules for performing an operation of the present disclosure, and vice versa.

A module or a programming module may include at least one of the above elements, or a portion of the above elements may be omitted, or additional other elements may be further included. Operations performed by a module, a program module, or other elements may be executed sequentially, in parallel, repeatedly, or in a heuristic method. Also, a portion of operations may be executed in different sequences, omitted, or other operations may be added.

The electronic devices described herein may include a cable having an appearance that continuously varies along a length of the cable, and thus the electronic devices as herein described may be molded to correspond to characteristics of various wearable devices.

In addition, the electronic devices described herein may include a joint part that moves within the cable, and thus the cable may be prevented from being twisted or exposed to the outside during the injection molding process.

While the present disclosure has been shown and described with reference to certain embodiments thereof, it should be understood by those skilled in the art that many variations and modifications of the method and apparatus described herein will still fall within the spirit and scope of the present invention as defined in the appended claims and their equivalents.

What is claimed is:

1. An electronic device comprising: a first coupling part including a first circuit board including at least one stacked structure; a second coupling parts including a second circuit board including at least one stacked structure, that is detachably connectable to the first coupling part; and a connection part connecting the first coupling part to the second coupling part, the connection part comprising: an injection molded upper end portion; an injection molded lower end portion being attached to the injection molded upper end portion; and a wire part disposed between the injection molded upper end portion and the injection molded lower end portion such that the wire part is enclosed by the injection molded upper end portion and the injection molded lower end portion, wherein the injection molded upper end portion, the injection molded lower end portion, and the wire part are connected in order without a fixing means, and wherein the connection part includes a joint part which radially protrudes from a center of the wire part.

2. The electronic device of claim 1, wherein the connection part has a cross-sectional area that varies along a length of the wire part.

3. The electronic device of claim 1, wherein the connection part forms an uninterrupted external surface with each of the first coupling part and the second coupling part.

4. The electronic device of claim 1, wherein, when the injection molded upper end portion is connected to the injection molded lower end portion, a space that extends a length of the connection part is formed therebetween.

5. The electronic device of claim 4, wherein the wire part is disposed within the space of the connection part.

6. The electronic device of claim 1, wherein the injection molded upper end portion comprises a first material and the injection molded lower end portion comprises a second material.

7. The electronic device of claim 6, wherein the second material is different from the first material.

8. The electronic device of claim 1, wherein the joint part is connected to both ends of the wire part, the joint part being connectable to each of the first coupling part and the second coupling part.

9. The electronic device of claim 8, wherein the joint part is movable along a length of the wire part.

10. The electronic device of claim 1, wherein the first coupling part and the second coupling part are connectable to each other by a magnet.

11. The electronic device of claim 1, wherein the first coupling part and the second coupling part have one of a same weight and a weight within a predetermined range.

12. The electronic device of claim 1, wherein each of the first coupling part and the second coupling part comprises a circuit board including at least one flexible portion.

13. A wearable electronic device to be mounted on a user's body comprising:

a first coupling part including a first housing and a first magnet formed on one surface of the first housing;

a second coupling part including a second housing and a second magnet facing the first magnet;

a first circuit board disposed within the first housing and including a first acoustic module;

a second circuit board disposed within the second housing and including a second acoustic module; and a connection part including a wire electrically connecting the first circuit board and the second circuit board and a molding member surrounding the wire and extending from the first housing to the second housing, wherein the first coupling part and the second coupling part are detachably coupled by the first magnet and the second magnet, wherein the outer surface of the molding member has a first curved surface formed on one side with respect to an axis perpendicular to the longitudinal direction of the wire, a second curved surface symmetrical to the first curved surface with respect to the axis, and a plane connecting the first curved surface and the second curved surface and oriented in the same direction as the axis, and wherein a vibration motor is disposed inside one of the first housing and the second housing, and a battery is disposed inside the other one of the first housing and the second housing.

* * * * *